United States Patent [19]

Felix et al.

[11] 4,320,933

[45] Mar. 23, 1982

[54] VENDING MACHINE WITH COMMON PANEL STRUCTURE

[75] Inventors: Cristian J. Felix, Flushing, N.Y.; Donald M. Genaro, Haworth, N.J.

[73] Assignee: PepsiCo Inc., Purchase, N.Y.

[21] Appl. No.: 112,172

[22] Filed: Jan. 15, 1980

[51] Int. Cl.[3] ..... A47B 77/08; B47B 81/00

[52] U.S. Cl. ..... 312/223; 312/204; 312/257 A; 312/291

[58] Field of Search ..... 312/223, 291, 292, 296, 312/204, 35, 42, 257 SK, 257 A, 257 SM

[56] References Cited

U.S. PATENT DOCUMENTS

| | | | |
|---|---|---|---|
| 1,260,854 | 3/1918 | Bardwell | 312/204 |
| 1,416,566 | 5/1922 | McCleary | 312/223 |
| 2,213,274 | 9/1940 | Flamm | 312/291 |
| 3,056,639 | 10/1962 | Caminker et al. | 312/204 |
| 3,367,730 | 2/1968 | Andrews et al. | 312/204 |
| 3,408,127 | 10/1968 | Vincens | 312/204 |
| 3,500,649 | 3/1970 | Feldman | 312/291 |
| 3,697,363 | 10/1972 | Martinez | 312/204 |
| 3,832,605 | 8/1974 | Clark, Jr. | 312/257 SM |
| 3,836,221 | 9/1974 | Whistler, Jr. et al. | 312/223 |
| 3,966,285 | 6/1976 | Porch et al. | 312/257 SK |
| 4,134,624 | 1/1979 | Moyer | 312/204 |
| 4,158,277 | 6/1979 | Krempp et al. | 312/204 |
| 4,179,169 | 12/1979 | Daniels et al. | 312/257 A |

FOREIGN PATENT DOCUMENTS

| | | | |
|---|---|---|---|
| 540619 | 5/1957 | Canada | 312/257 A |

*Primary Examiner*—Victor N. Sakran

*Attorney, Agent, or Firm*—Scully, Scott, Murphy & Presser

[57] ABSTRACT

A vending machine providing for easy and convenient repair of the machine in the event of external damage thereto as by defacement or vandalism. The front surface of the vending machine has a removable panel covering a substantial portion of the front surface area. The side surfaces of the machine are also provided with removable panels which are identical to the panel on the front surface such that a single type of replacement panel may be used to provide repairs for three different sides of the machine in the event any one of the panels is mutilated or defaced. The identical panels extend for substantially the full height of the vending machine and extend for substantially the full width of the sides of the machine and across a substantial portion of the width of the front thereof, thereby providing coverage of a substantial portion of damagable surface areas of the vending machine. The identical panels may be constructed from a durable plastic material such as Lexan, and be decorated with suitable product identification indicia.

4 Claims, 5 Drawing Figures

VENDING MACHINE WITH COMMON PANEL STRUCTURE

BACKGROUND OF THE INVENTION

1. Field of the Invention

The present invention relates generally to an improved design for a vending machine, and more particularly pertains to a vending machine which is designed to minimize the time, problems and expense encountered in repairing damage caused by defacement or vandalism of the machine. Furthermore, the present invention relates to a design for a vending machine which has a pleasing aesthetic appearance.

2. Discussion of the Prior Art

Vending machines for products such as soft drinks are frequently subjected to incidents of vandalism and defacement. Machines of this nature are often accessible for up to twenty-four hours each day to vandals and potential thieves at locations which provide an opportunity for vandalism or defacement of the machines without affording assurances that the vandals or thieves will be noticed or apprehended. In view thereof, these machines must frequently be serviced by repair personnel in order to permit the machines to retain an aesthetically acceptable appearance. Repairs of a minor nature may sometimes be affected by service personnel who periodically restock the machine. However, damage to the machines of a more severe nature often requires one or more visits by skilled repair personnel to repair and/or replace vandalized components of the machine so as to return the latter to an acceptable aesthetic appearance. Moreover, damage of a more severe kind of the exterior of the machine often requires return of the vending machine to a service facility wherein the extensive damage can be repaired which, in effect, removes the machine from a potentially profitable vending location. Of the above mentioned types of repair operations, the least expensive alternative mode of repair is that performed by service personnel who periodically replenish the stock in the machine.

Heretofore, vending machines of the type, discussed have usually been provided with decoratively painted metal panels covering a major portion of their exterior or visible surface area. The metal panels are frequently the object of defacement and vandalism in the form of having graffiti spray painted thereon, or being scratched, or being dented to a deformed condition. Thus it becomes highly desirable to provide for a vending machine in which damage or vandalism of this nature can be readily repaired in a simple manner at the vending site by relatively unskilled personnel who normally periodically replenish stock in the machine.

SUMMARY OF THE INVENTION

Accordingly, it is a primary object of the present invention to provide a dispensing machine which is designed to increase the number of repairs performable thereon at its vending site by either service personnel who normally restock the machine or by an employee having a minimal level of skill.

Another object of the present invention is the provision of a vending machine wherein the organization of all functional items thereon such as coin handling, information, product selection and dispensing is positioned towards one side of the front panel of the machine, thereby allowing the remaining portion of the front panel on the opposite side thereof to be a fully decorated and/or illuminated top to bottom sign panel which may be utilized for purposes of advertising and/or for decoration.

A further object of the present invention is the provision of a vending machine incorporating three similarly sized, removable and decorated sign panels which are mounted on the front and side surfaces thereof so as to provide equally sized repetitions of sign displays when viewed from the front, left or right sides of the machine.

Another object of the present invention is to provide a vending machine having a major portion of its external surface covered by high impact strength sign panels of substantially identical construction and interchangeability which facilitate greater ease of on-site replacement through the utilization of detachable moldings, the mountings or fastenings for which are only accessible from the interior of the vending machine.

Accordingly, the invention contemplates an improved design for a vending machine which provides for the easy and convenient repair of the vending machine at its vending site in the event of vandalism or damage thereto. The vending machine has a front surface which has a removable sign panel mounted thereon covering a substantial portion of the machine front surface area. At least one and preferably both, of the side surfaces of the machine is also provided with a removable sign panel which is identical in construction and size to the panel mounted on the front surface of the machine. The identical panel construction allows a service employee to perform many on-site repairs to a vending machine in order to restore it to an acceptable aesthetic appearance while carrying a minimal number of spare parts and tools, and thereby avoiding the necessity of removal of the machine to a repair or servicing facility. One replacement panel may be used to provide repairs for several sides of the machine. Further, if a replacement panel is temporarily unavailable and the front panel of the machine is defaced or vandalized, the front panel may be temporarily replaced by one of the less visible side panels so as to restore the more important aesthetic appearance at the front of the machine.

Furthermore, in a preferred embodiment of the invention, both of the side surfaces of the machine have identical removable sign panels mounted thereon to provide equal repetition of a sign display on each panel when seen from left or right angled or perspective frontal views. Each of the panels may be constructed from a durable plastic material such as Lexan, and be decorated with suitable product identification indicia, preferably on the back or interior surface thereof. Further, the front panel may be translucent and be illuminated from interiorly of the vending machine, with the illumination being controlled by a light sensitive switch to conserve power consumption during daylight hours.

The side panels are mounted on the side surfaces of the machine by means of detachable moldings, with the mountings for the moldings being accessible only from the interior of the machine. All of the selection switches, coin insertion and return functions, product dispensing opening, etc. are positioned on one side of the front surface of the machine, with the front panel being positioned on the opposite side thereof. Furthermore, the identical panels extend for substantially the full height of the vending machine and for substantially the full width of the sides of the machine and across a major portion of the width of the front thereof, thereby providing coverage of a substantial portion of the possibly damagable surface areas of the machine.

BRIEF DESCRIPTION OF THE DRAWINGS

The foregoing and other objects and advantages of the novel vending machine constructed pursuant to the teachings of the present invention may be more readily understood by one skilled in the art having reference to the following detailed description of a preferred embodiment thereof, taken in conjunction with the accompanying drawings wherein identical reference numerals are utilized to refer to like elements throughout the several views; and in which.

DETAILED DESCRIPTION OF THE DRAWINGS

Figure 1:
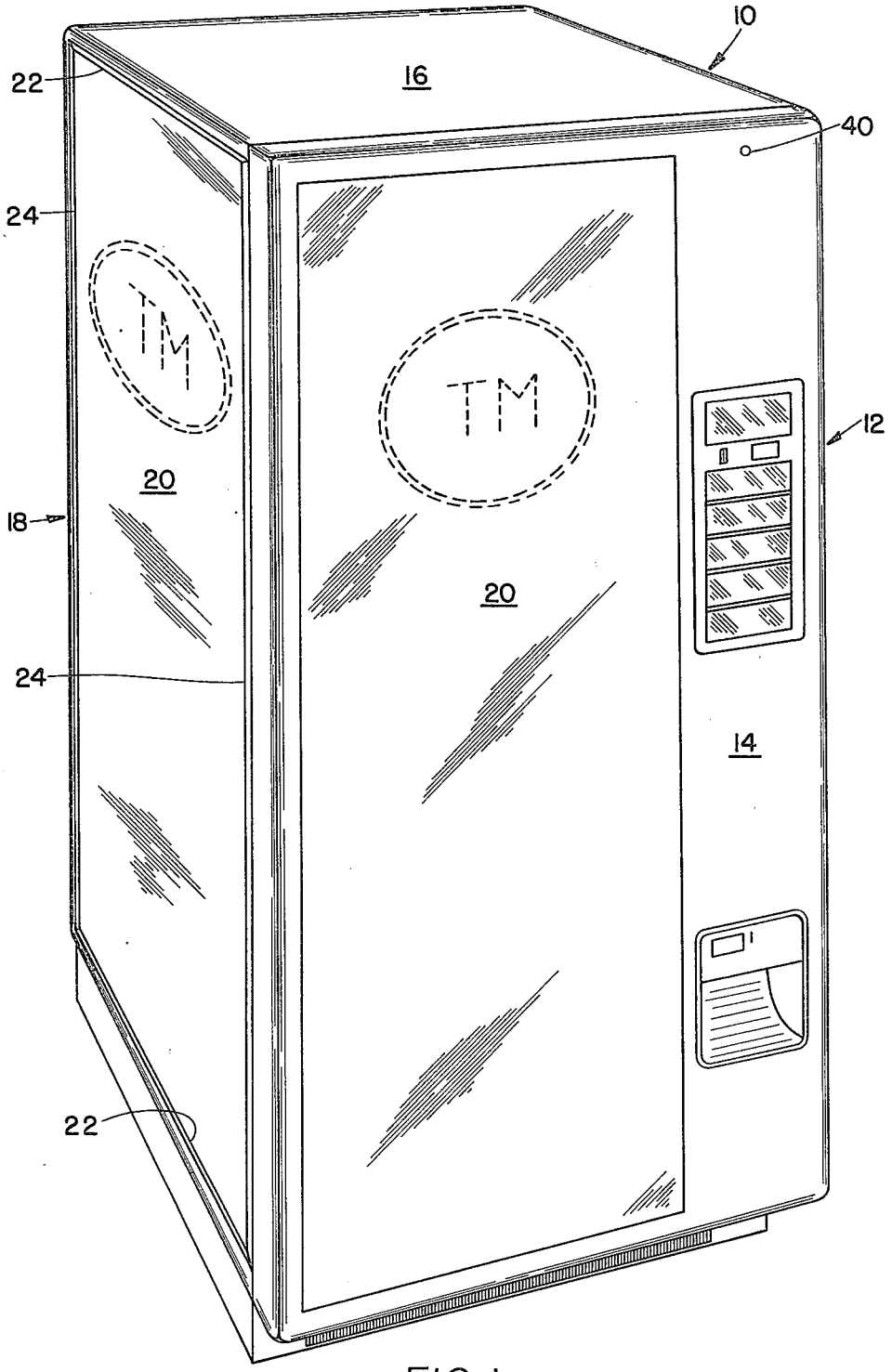
FIG. 1 is a frontal perspective view of a vending machine for soft drinks constructed pursuant to the teachings of the present invention.
Figure 2:
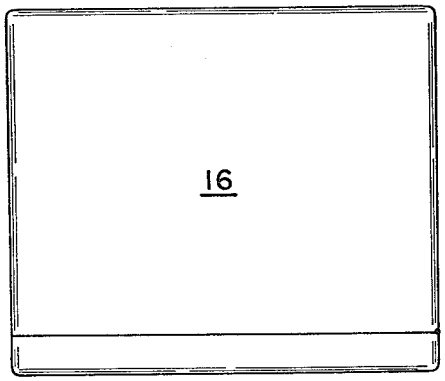
FIG. 2 is a plan view of the machine shown in FIG. 1.

Referring to the drawings in detail, FIG. 1 illustrates a vending machine 10 of the type, for example, which may dispense containers of soft drinks. The vending machine may incorporate security features as taught in copending U.S. Patent Application Ser. No. 112,170, entitled SECURITY PYLON FOR A VENDING MACHINE, filed Jan. 15, 1980, and furthermore, the front selection panel 12 for the machine may be constructed in accordance with the teachings of copending U.S. Patent Application Ser. No. 152,523, entitled CAPACITIVE SWITCHING PANEL, filed May 22, 1980; both assigned to the common assignee of this application.

In accordance with the teachings of the latter copending patent application, an improved selection panel incorporates touch-actuated capacitive selection switches, and provides a facility to readily change the visible indicia indicating the nature of the selection provided by each switch. The tooth actuated capacitive switches are formed on a common transparent glass substrate having first and second transparent conductive coatings on opposite sides thereof. The glass substrate has a common conductive coating on one side, and a plurality of discrete separate conductive coated areas on its opposite side forming the separate capacitive switches. An opaque delineation pattern may be provided on the substrate to provide a visible separation of the different areas on the several switches. A common frame for the indicia associated with each switch is positioned behind and adjacent to the coated substrate. A removable rectangular paper indicia tab is provided for each capacitive switch, and is positioned in the frame adjacent to the coated substrate such that the indicia is visible therethrough and indicates the nature of the switching function. The common frame provides opposed U-shaped slots on opposite sides of each capacitive switch, such that the rectangular paper tabs is slideable between a pair of opposed slots. Moreover, a metal barrier panel may be provided behind the substrate to prevent access to the interior of the machine in the event of breakage of the glass substrate.

Figure 3:
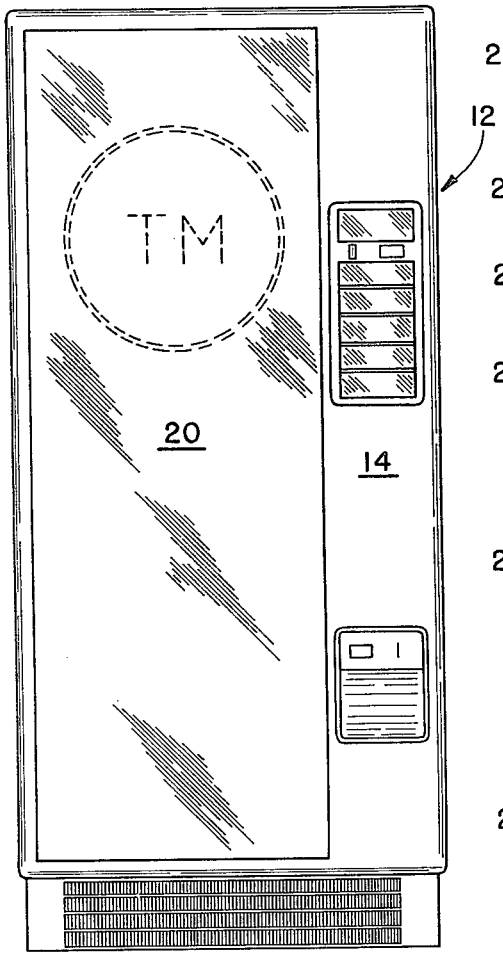
FIG. 3 is a frontal elevational drawing of the same vending machine.

The arrangement illustrated in FIGS. 1 and 3 is such that the functional items required on the front surface 14 of the dispensing machine, such as coin handling and dispensing, product information, product selection and dispensing, etc., are provided on the right portion of the front surface. The top surface 16, rear surface and side surfaces 18 of the vending machine are normally constructed primarily of sheet metal, although other types of materials could also be used in alternative embodiments. The portion of the front panel surrounding the functional items on the right side thereof and surrounding front a decorative panel 20 are also constructed of sheet metal in a typical fashion.

In accordance with the teachings herein, at least one and preferably two side decorative panels 20, identically sized with the front panel, are mounted on the side surfaces of the machine. All of the decorative panels are identically decorated with trademark or product identification indicia, or simply with aesthetic decorations. The decorative panels may be formed of any suitable clear material such as plastic, and may be constructed of Lexan to provide high impact strength to withstand the ravages of vandalism. Also the single sheet, unitary nature of the panel construction allows for greater ease of on-site replacement of panels.

The side panels extend over substantially the full height and width of the sides of the machine, thereby providing maximum coverage of the side areas of the machine. In the event that a side of the machine is defaced or vandalized, a simple replacement of the decorative panel will repair and restore a pleasing aesthetic appearance to the machine. Each side panel is secured in place by a simple detachable frame consisting of top and bottom molding members 22 which overlap the top and bottom edges of the panel and side molding members 24 overlapping the side edges of the panel. The detachable moldings 22 and 24 may be secured in place relative to the sheet metal side of the machine by small screws or bolts 26 which extend through holes in the sheet metal and engage threaded apertures provided in the frame members 22 and 24 outside the perimeter of the decorative panel, as illustrated in phantom FIG. 4. Accordingly, the moldings may be detached from the machine to release a decorative panel only after the machine has been unlocked and opened by authorized service personnel. Further, removal of a side panel 20 would probably not require detachment of all four moldings, and removal of only one or two molding members would normally be sufficient to allow the release of a side decorative panel. In some embodiments of the present invention, other types of fasteners besides screws may be used to detachably couple the moldings 22 and 24 to the machine.

Figure 4:
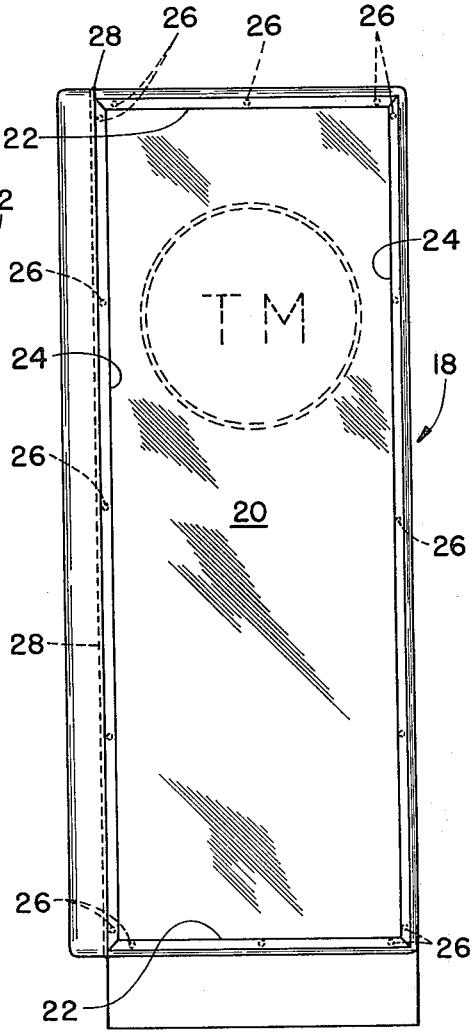
FIG. 4 is a right elevational view of the vending machine.
Figure 5:
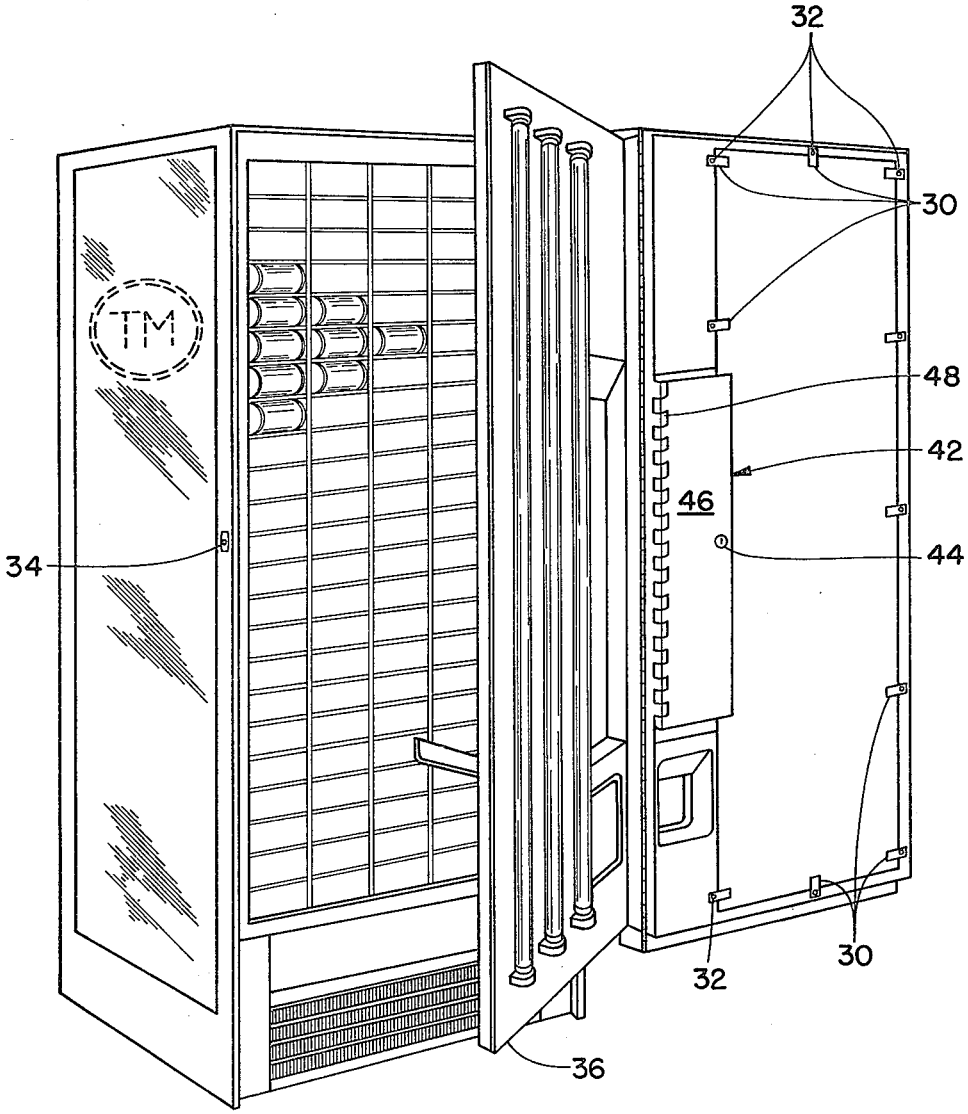
FIG. 5 is a frontal perspective view of the soft drink vending machine with the front panel door opened fully, providing a view of the interior of the machine.

The front sheet metal panel also forms a door for the vending machine which pivots about the right front corner of the machine by a piano hinge 28, illustrated in phantom in FIG. 4. A large rectangular opening is provided in the front sheet metal door to accomodate the positioning therein of a front decorative panel 20, which may be secured to the door by a plurality of clips 30. The clips 30 may be simply in the nature of the type of clips utillized to hold window or door screens or glass panels in place in storm windows and doors. A thumbscrew 32 on each retainer clip provides for easy removal of a clip when replacement of the front panel is desired. The removable clips 30 are accessible only when the vending machine is opened, and accordingly the front decorative panel 20, like the side panels, can only be removed by authorized personnel.

The common panel structure disclosed herein allows a service employee to perform many on site repairs to a vending machine to restore it to an acceptable aesthetic appearance while carrying a minimal number of spare parts and tools. One replacement panel may be used to provide repairs for three sides of the machine. Further, if a replacement panel is temporarily unavailable, and the front panel on the machine is defaced or mutilated, the front panel may be exchanged with one of the less visible side panels to temporarily improve the aesthetic appearance of the machine.

A lock 34 is provided on the exterior of the vending machine to unlock the front door when access to the interior of the machine is desired by service personnel. This lock may be of any suitable type such as one using interengaging rods and apertures at several positions around the perimeter of the front door.

As an optional feature of the present invention, a security and illumination panel 36 is provided immediately behind the front decorative panel 20. The illumination panel includes a plurality of vertically extending fluorescent lamps 38 to illuminate the front decorative panel from interiorly of the machine during nighttime hours. A photocell 40 may be provided, preferably on the front or top surface of the machine, to sense when ambient illumination falls below a given threshold to initiate illumination of the fluorescent lamps. Accordingly, the illumination is extinguished during daylight hours, thereby resulting in conservation of electrical power during daytime hours when illumination of the sign is not required. The illumination panel is constructed of sheet metal and provides security for the interior of the machine in the event the front decorative panel is shattered, effectively precluding access to the interior of the vending machine by vandals or thieves. Illumination is provided only for the front panel of the machine, as the side panels are not illuminated internally. It is contemplated that some embodiments of the present invention will not be provided with an illumination panel. Embodiments of that nature may eliminate the back illumination panel entirely, and accordingly the large rectangular opening in the front door normally accommodating the front decorative panel may also be eliminated. In those embodiments the front decorative panel may be mounted over the continuous outer sheet metal surface of the front door by detachable moldings in a manner similar to that illustrated herein for the side panels.

The vending machine may also incorporate a security pylon 42 internally thereof access to which is obtained by opening a second lock 44. The security pylon is mounted on the back or interior surface of the front door of the vending machine, and encloses all of the cash functions of the machine such as the cash receipts and coin dispenser. The second lock 44 opens a pylon door 46 which is pivotable relative to the front door structure by a piano hinge 48. The key for the second lock 44 may be different from the key for the lock 34 for the machine front door such that access to cash in the machine may be obtained only by authorized personnel having the proper first and second keys. A design of this nature allows selected types of personnel, such as a delivery employee, access to the interior of the machine to perform given functions therein, such as restocking and repair, while denying access to the cash in the machine. It also presents a second barrier to potential thieves who might pry open the front door with a crowbar or other instrument. The security pylon is constructed of sheet steel of a thicker gauge than that utilized in other portions of the vending machine. Further, the machine may incorporate an audio and/or visual alarm which is activated in the event that either the outer door or the security pylon is breached in an unauthorized fashion. The alarm may be designed with a power supply independent of that of the AC voltage supplying electrical power to the vending machine such that it would not be deactivated by unplugging of the machine.

The visible sheet metal areas of the machine may be painted in a suitable color such as black with a textured finish to provide an aesthetically attractive machine. The entire exterior sheet metal surface of the machine is generally painted, including those portions normally covered by removable sign panels. This feature of the present invention enables one of the side decorative panels to be completely removed while still presenting a somewhat acceptable and pleasing aesthetic appearance to the vending machine. Case to door overlap may be provided both along the joinder of the left portion of the front door with the left side panel and also along the edges of the security pylon to prevent the leverage of a tool such as a crowbar acting to gain unathorozed access to the machine.

While one embodiment and several variations of the present invention has been described in detail herein, it should be apparent that the disclosure and teachings herein will suggest many alternative embodiments and variations to one of ordinary skill in this art.

What is claimed is:

1. A vending machine providing for easy and convenient on site repair of the machine in the event of damage thereto, comprising:

a. a housing including a frame structure with top, front and side surfaces, said front surface being an openable door affording access to interior portions of the machine;

b. vend operating means including product selection switches, coin insertion and return means, and a product dispensing opening being arranged along one side of the front surface of said machine;

c. a first removable, decorative panel being detachably mounted on said front surface, said panel covering the major portion of said front surface while leaving said vend operating means exposed;

d. at least one further removable, decorative panel identical to said first panel being located on at least one of the side surfaces of said machine and being substantially coextensive with the side surface;

e. detachable moldings on said side surface for mounting said further panel, and means for fastening said moldings to said side surface accessible only from the interior of the machine upon opening of said door whereby a portion of said molding is adapted to be removed through loosening of said fastenings to facilitate slidable disengagement of said further panel and replacement therewith of said first panel on said front surface when said first panel has been damaged or vandalized.

2. A vending machine as claimed in claim 1, said identical panels each being constructed from a rigid plastic material, and being decorated with product identification indicia.

3. A vending machine as claimed in claim 1, including means for illuminating front panel from interiorly of the vending machine.

4. A vending machine as claimed in claim 1, said illumination means comprising an illumination panel having a plurality of fluorescent lamps mounted behind the front panel, and a photocell to enable operation of the illumination panel only when ambient external illumination falls below a given threshold level.

* * * * *

UNITED STATES PATENT AND TRADEMARK OFFICE

CERTIFICATE OF CORRECTION

PATENT NO. : 4,320,933

DATED : March 23, 1982

INVENTOR(S) : Cristian J. Felix

It is certified that error appears in the above–identified patent and that said Letters Patent are hereby corrected as shown below:

Column 3, line 48 "tooth" should read as --touch--.

Signed and Sealed this

*Thirty-first* Day of *August 1982*

[SEAL]

*Attest:*

GERALD J. MOSSINGHOFF

*Attesting Officer*

*Commissioner of Patents and Trademarks*